US009028687B2

(12) United States Patent
Goraj

(10) Patent No.: US 9,028,687 B2
(45) Date of Patent: May 12, 2015

(54) SEPARATING DEVICE FOR SEPARATING MAGNETIC OR MAGNETIZABLE PARTICLES PRESENT IN SUSPENSION

(75) Inventor: Robert Goraj, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 82 days.

(21) Appl. No.: 14/002,649

(22) PCT Filed: Feb. 21, 2012

(86) PCT No.: PCT/EP2012/052926

§ 371 (c)(1),
(2), (4) Date: Aug. 30, 2013

(87) PCT Pub. No.: WO2012/116909

PCT Pub. Date: Sep. 7, 2012

(65) Prior Publication Data

US 2013/0327693 A1 Dec. 12, 2013

(30) Foreign Application Priority Data

Mar. 2, 2011 (DE) ..... 10 2011 004 958

(51) Int. Cl.
*B03C 1/033* (2006.01)
*B03C 1/253* (2006.01)
*B03C 1/28* (2006.01)

(52) U.S. Cl.
CPC ..... *B03C 1/0335* (2013.01); *B03C 1/0332* (2013.01); *B03C 1/253* (2013.01); *B03C 1/288* (2013.01); *B03C 2201/18* (2013.01)

(58) Field of Classification Search
CPC .... B03C 1/0335; B03C 1/0332; B03C 1/288; B03C 1/253; B03C 2201/18
See application file for complete search history.

(56) References Cited

U.S. PATENT DOCUMENTS

| | | | |
|---|---|---|---|
| 3,988,240 | A | 10/1976 | Fraas |
| 6,558,541 | B1 | 5/2003 | Morrison |
| 2011/0147295 | A1 | 6/2011 | Penas Ballester et al. |
| 2011/0168607 | A1 | 7/2011 | Ries |
| 2013/0015106 | A1 | 1/2013 | Lins et al. |

FOREIGN PATENT DOCUMENTS

| | | | |
|---|---|---|---|
| DE | 115808 | A1 | 2/1897 |
| DE | 102008047852 | A1 | 4/2010 |
| DE | 102009035764 | A1 | 2/2011 |
| EP | 1 974 821 | A1 | 10/2008 |

(Continued)

OTHER PUBLICATIONS

Translation of the Chapter II International Preliminary Report on Patentability for PCT/EP2012/052926, undated.*
German OA for Application No. 102011004958.4; dated Aug. 11, 2011.

(Continued)

*Primary Examiner* — David A Reifsnyder
(74) *Attorney, Agent, or Firm* — Staas & Halsey LLP

(57) ABSTRACT

A separating device has a separating channel, through which a suspension can flow, a ferromagnetic yoke arranged on one side of the separating channel and a separating element arranged at the outlet of the separating channel for separating magnetic or magnetizable particles in the suspension. A plurality of coils arranged along the separating channel are controlled by a control device to produce a magnetic deflection field. The control device produces alternating current directions for controlling neighboring coils.

9 Claims, 2 Drawing Sheets

(56) References Cited

FOREIGN PATENT DOCUMENTS

| | | | |
|---|---|---|---|
| EP | 2327665 | A1 | 6/2011 |
| EP | 2 368 639 | A1 | 9/2011 |
| WO | 2010/023335 | A1 | 3/2010 |
| WO | 2010/037162 | A1 | 4/2010 |

OTHER PUBLICATIONS

International Search Report for PCT/EP2012/052926; mailed Jun. 4, 2012.

Office Action issued Oct. 24, 2013 in corresponding German Application No. 102011004958.4.

* cited by examiner

SEPARATING DEVICE FOR SEPARATING MAGNETIC OR MAGNETIZABLE PARTICLES PRESENT IN SUSPENSION

CROSS REFERENCE TO RELATED APPLICATIONS

This application is the U.S. national stage of International Application No. PCT/EP2012/052926, filed Feb. 21, 2012 and claims the benefit thereof. The International Application claims the benefit of German Application No. 10 2011 004 958.4 filed on Mar. 2, 2011, both applications are incorporated by reference herein in their entirety.

BACKGROUND

Described below is a separating device, for separating magnetic or magnetizable particles present in a suspension, having a separating channel through which the suspension can flow, a ferromagnetic yoke arranged on one side of the separating channel, and a separating element arranged at the outlet of the separating channel for separating the magnetic or magnetizable particles. A plurality of coils are arranged along the separating channel that can be controlled by a control device.

A separating device of this kind is known from DE 10 2008 047 852 A1. This separating device is used for a continuous method for separating a mixture of both magnetizable and non-magnetizable particles. With this separating device, it is provided that a magnetic deflecting field, which is variable in terms of time, is generated by the coils, in particular a travelling wave so that the particles accumulate under the influence of the magnetic field or the magnetic field gradient on an inner surface of the separating channel. While a current flows through the separating channel, the magnetizable particles accumulate on the wall of the separating channel so that they can be separated on leaving the separating channel. In contrast to a constant magnetic field, a traveling field which is variable in terms of time is provided so that field-free regions exist in which there is no magnetic field gradient. These field gaps travel with the flow so that, on encountering a field gap, a magnetic or magnetizable particle is released again from the wall of the separating channel and is transported further by the flow. This ensures that there is no excessive build-up of particles, which would have to be removed by a discontinuous method or a corresponding procedural step.

Separating devices can be used to separate a mixture or a suspension of magnetizable and non-magnetizable particles. Here, use is made of a traveling field, which moves along a separating channel in the direction of a separating baffle. This traveling field exerts a force on the magnetic particles, which is directed both toward the wall and perpendicularly thereto, in the direction of flow of the suspension. The combination of this force with the hydrodynamic force of the flowing suspension causes the magnetic particles to be concentrated in the vicinity of the wall of the separating channel and transported in the direction of a separating baffle. The energization of the coils arranged in series along the separating channel takes place such that, at a particular time in neighboring coils the current flows in the same direction, neighboring coils only differ with respect to their phase angle. In the longitudinal direction of the coil arrangement, the current varies in the form of sinusoidal half-waves, which alternate with field-free regions or time segments.

Investigations with the separating device known from DE 10 2008 047 852 A1 revealed that unwanted force components occur in partial regions of the separating channel, the components causing the particles to be moved away from the wall of the separating channel through which the flow passes so that subsequently a certain proportion of the particles could not be separated.

SUMMARY

The separating device enables better separation of the magnetic or magnetizable particles. To achieve this, the separating device has a control device formed with alternating current directions for controlling neighboring coils. As a result, the detrimental force components that cause particles to be moved away from the wall of the separating channel can be avoided in that neighboring coils are fed with oppositely directed currents. The desired separating effect is hence achieved by a different effect than is the case with the separating device according to DE 10 2008 047 852 A1.

Thus, neighboring coils are fed with different, i.e. opposite, current directions. During this, the absolute value and the shape of the currents in the longitudinal direction of the separating channel remain unchanged, i.e., the current has a sinusoidal shape. However, the direction of the current is different from one coil to the next coil and neighboring coils have opposing current directions. Calculations and tests have shown that the gradient of the magnetic field perpendicular to the direction of flow substantially only point in the direction toward the coils or toward the inner wall of the separating channel, accordingly, the separating device enables magnetic and magnetizable particles to be separated with a high degree of efficiency.

The control device can be formed such that the gradient of the magnetic field generated by the coils is substantially directed toward the coils. This advantageous effect is a consequence of the oppositely directed currents explained above which ensure that no significant force components in other directions, for example away from the coils, are generated. This results in the further advantage of the minimization of the current demand needed for the operation of the separating device.

According to a development of the separating device, each coil can be assigned its own control device. Accordingly, each coil can be controlled individually thus enabling the desired current pattern to be generated.

It is also within the scope of the separating device that the at least one control device is embodied as a programmable power supply unit or as a converter. The power supply unit or the converter enables the current fed to a coil to be set and controlled in the desired way.

Particularly good separation can be achieved with the separating device if the opposite currents of neighboring coils are out-of-phase. The delay in the generated currents causes an alternating traveling field to form resulting in the formation of the desired force components, which act on the particles in the suspension.

The phase displacement of the currents of neighboring coils may be 5°-20°, in particular 10°. It is also conceivable that the delay of neighboring coils can be set.

In the separating device each coil may be energized with a positive or a negative half-wave. During several cycles, the same coil can be energized once with a positive half-wave and then with a negative half-wave. Here, it is essential that neighboring coils are in each case exposed to currents with alternating current directions.

In this context, the coil may be substantially de-energized between two half-waves. Accordingly, a positive half-wave does not immediately change into a negative half-wave, instead a period exists in which the coil is not energized. Since in this condition, there is no magnetic field gradient, no force acts on magnetic or magnetizable particles so that they are transported further by the hydrodynamic forces of the suspension. This has the advantage that it avoids the adhesion of a large number of particles to a particular place, which would otherwise have to be removed by another electrical or mechanical means.

A displacer may be arranged in the separating channel of the separating device. A, for example cylindrical, displacer results in the formation of an annular separating channel with a desired width. A separating baffle may be arranged at the end of the separating channel in order to separate the magnetic and magnetizable particles from dead rock.

BRIEF DESCRIPTION OF THE DRAWINGS

These and other aspects and advantages will become more apparent and more readily appreciated from the following description of the exemplary embodiment, taken in conjunction with the accompanying drawings of which.

DETAILED DESCRIPTION OF THE PREFERRED EMBODIMENT

Figure 1:
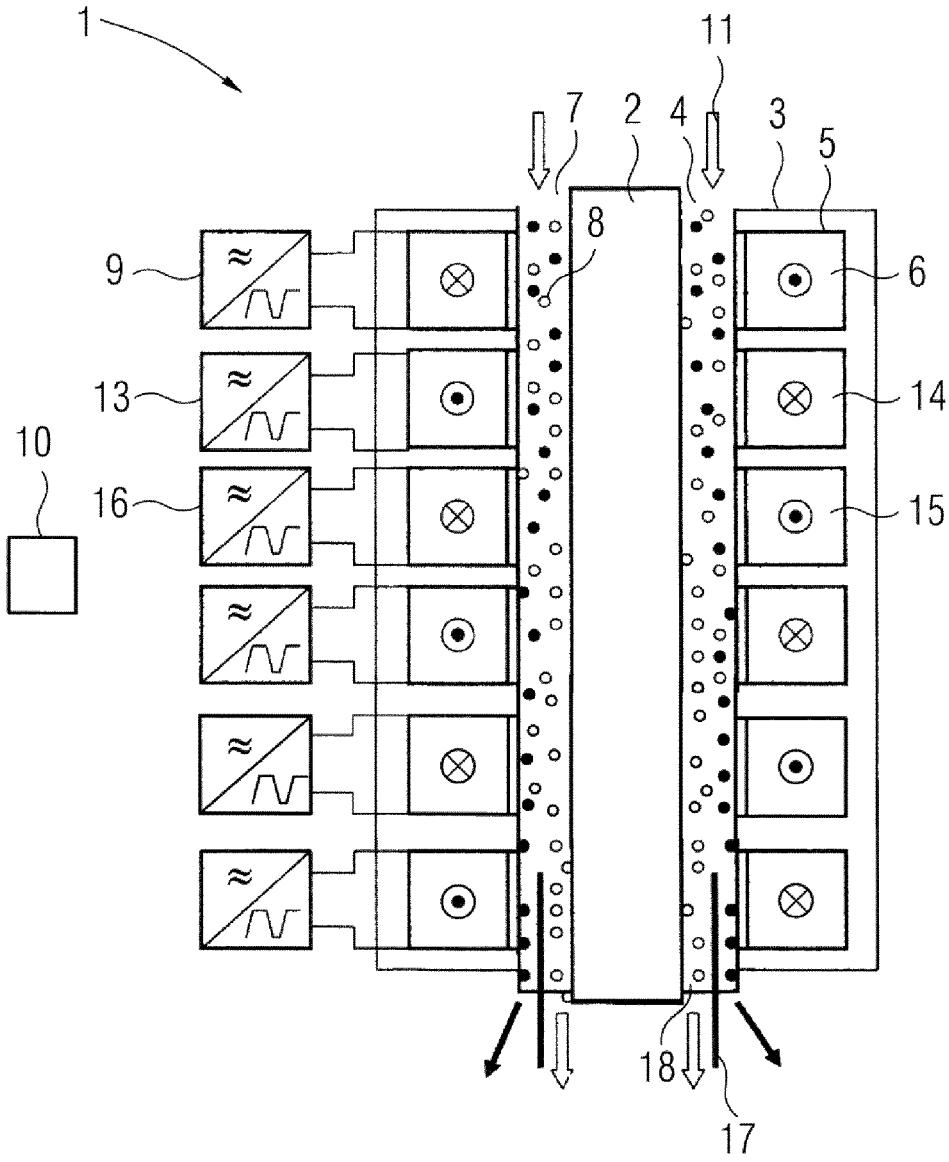
FIG. 1 is a schematic cutaway view of a separating device.

Reference will now be made in detail to the preferred embodiments, examples of which are illustrated in the accompanying drawings, wherein like reference numerals refer to like elements throughout.

The separating device 1 shown in FIG. 1 has a cylindrical displacer 2, surrounded at a distance by a coaxial cylindrical yoke 3 made of iron. An annular separating channel 4 is formed between the displacer 2 and the yoke 3. The iron yoke has circumferential grooves 5 in which coils 6 are arranged. The separating channel 4 and the coils 6 are separated from each other by a partition wall, which is not shown in further detail, so that a liquid flowing through the separating channel 4 does not touch the coils 6. This exemplary embodiment shows six coils, but this should be understood as an example only, any number of coils arranged one behind the other in the direction of flow can be chosen.

An inlet 7 of the separating channel 4 is filled continuously with a suspension 8 via a charging means embodied as a pump. The suspension 8 contains magnetizable and non-magnetizable components as powder or particles contained in a liquid. In the exemplary embodiment shown, water is used as the liquid. The direction of flow is indicated by the arrow 11. The non-magnetizable components are also referred to as dead rock. The separating device 1 should separate the magnetizable components from the suspension.

The separation of the magnetizable particles contained in the suspension 8 is performed by controlled energization of the plurality of coils 6, which are each assigned a programmable power supply unit 9. The power supply units 9 are each used as control devices in order to control the current supplied to a coil 6. All power supply units 9 are connected via electrical connections, which are not shown in further detail, to a controller 10, which controls the individual power supply units 9, in particular the phase relation of the individual currents.

A particular, fixed energization of the power supply units 9 generates an electromagnetic field, the gradient of which substantially points in the direction of the coils, i.e. radially outward so that magnetic particles are moved in the direction of the coil.

Figure 2:
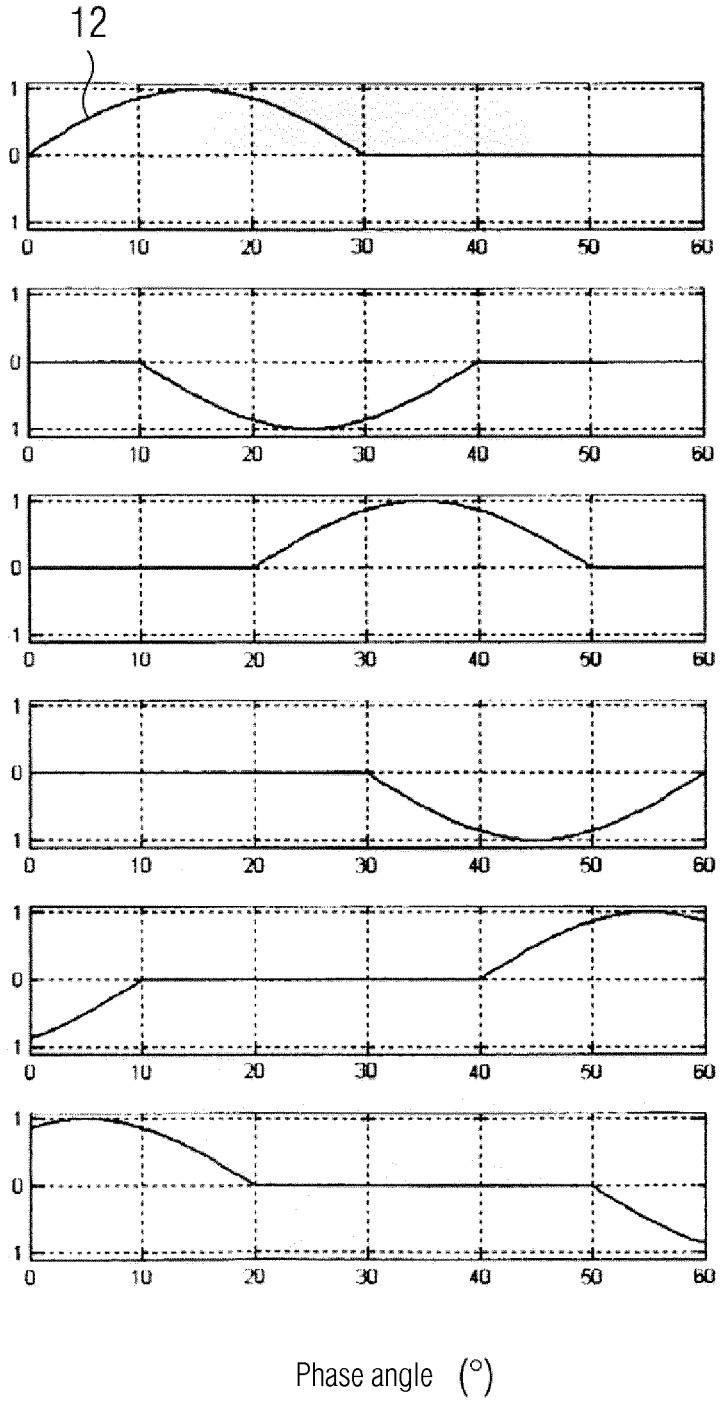
FIG. 2 contains graphs of current paths for a plurality of coils in the separating device, wherein the current path is plotted over the phase angle.

To explain the current path, reference is also made to FIG. 2. FIG. 2 shows by way of example for the six coils 6 how the current changes over the phase angle. The phase angle is plotted on the horizontal axis, the normalized current on the vertical axis. During the energization of the coils 6, it is essential for neighboring coils 6 to be energized with opposite current directions. As is evident from both FIG. 1 and FIG. 2, neighboring coils 6 have alternating current directions. A power supply unit 9, which is connected to the controller 10, controls the current, which is fed to a coil 6. As is evident from the top diagram in FIG. 2, the current fed to the first coil has the shape of a positive half-wave 12. The approximately sinusoidal half-wave 12 is located above the horizontal axis, therefore this current is defined as positive. This current is used to control the topmost coil 6 shown in FIG. 1. After passing through a particular phase segment, in the exemplary embodiment shown after 10°, the neighboring coil 14 is controlled by the power supply unit 13 assigned thereto. However, the neighboring coil 14 is exposed to a current with the opposite preliminary sign and which is therefore shown under the horizontal axis in FIG. 2. Accordingly, the currents to which the coils 6, 14 are exposed have opposite directions and opposite preliminary signs. The value and duration of the half-wave of the current is, however, the same in both cases.

Similarly, a neighboring coil 15 is energized by a power supply unit 16 as soon as the phase angle 20° is reached. The current fed to the coil 15 has the opposite preliminary sign to that of the neighboring coil 14, hence this is a positive half-wave. Accordingly, the respective neighboring coil is passed through by a current with the reverse preliminary sign, which is displaced by a particular phase angle, in the exemplary embodiment shown 10°. Accordingly, positive and negative half-waves alternate, in each case in respect of a phase displacement. As shown in FIG. 2, a positive or negative half-wave has a phase length 30°, which is then followed by a de-energized phase segment. During de-energization, no magnetic field gradient and hence no force acts on the particles present in the suspension 8, accordingly they are released from the inner surface of the separating channel 4 and are further transported by the hydrodynamic force of the flow.

When a magnetizable particle passes an energized coil, it moves under the influence of the magnetic field gradient radially in the direction of the coil until it reaches the outer edge of the separating channel 4. In this way, the magnetic particles are continuously moved further outward so that they accumulate along the separating channel. Hence, a region forms at the outer edge of the separating channel in which the magnetic particles are present in a high concentration.

A separating baffle 17 is arranged at the lower end of the separating channel so that the magnetic particles, which are shown in FIG. 1 as solid circles, can be separated from the suspension 8 as a concentrate. The remaining part of the suspension 8 leaves the separating channel 4 by an outlet 18.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A separating device for separating magnetic or magnetizable particles present in a suspension, comprising:

a separating channel through which the suspension can flow to an outlet thereof;

a ferromagnetic yoke arranged on one side of the separating channel;

a separating element arranged at the outlet of the separating channel for separating the magnetic or magnetizable particles;

a plurality of coils arranged along the separating channel; and at least one control device controlling the coils by controlling neighboring coils with alternating current directions that are out-of-phase, each coil energized only by one of a positive half-wave and a negative half-wave.

2. The separator device as claimed in claim 1, wherein the at least one control device causes a magnetic field generated by the coils to have a gradient substantially directed toward the coils.

3. The separating device as claimed in claim 2, wherein each coil is assigned a corresponding control device.

4. The separator device as claimed in claim 3, wherein each control device is one of a programmable power supply unit and a converter.

5. The separating device as claimed in claim 4, wherein currents in the neighboring coils have a phase displacement of 5° to 20°.

6. The separating device as claimed in claim 5, wherein the phase displacement is substantially 10°.

7. The separator device as claimed in claim 5, wherein each coil is substantially de-energized between two half-waves.

8. The separating device as claimed in claim 7, further comprising a displacer arranged in the separating channel.

9. The separating device as claimed in claim 8, further comprising a separating baffle arranged at the outlet of the separating channel.

* * * * *

UNITED STATES PATENT AND TRADEMARK OFFICE

CERTIFICATE OF CORRECTION

PATENT NO. : 9,028,687 B2
APPLICATION NO. : 14/002649
DATED : May 12, 2015
INVENTOR(S) : Robert Goraj It is certified that error appears in the above-identified patent and that said Letters Patent is hereby corrected as shown below:

In the claims

Claim 2, Column 5, Line 16:

Delete "separator" and insert --separating--, therefor.

Claim 4, Column 6, Line 3:

Delete "separator" and insert --separating--, therefor.

Claim 7, Column 6, Line 12:

Delete "separator" and insert --separating--, therefor.

Signed and Sealed this
Thirteenth Day of October, 2015

Michelle K. Lee

Michelle K. Lee
*Director of the United States Patent and Trademark Office*